United States Patent [19]

Greenwood

[11] 4,330,713

[45] May 18, 1982

[54] CUSHIONED STARTER PINION

[75] Inventor: Leon D. Greenwood, Eaton Rapids, Mich.

[73] Assignee: Eaton Stamping Company, Eaton Rapids, Mich.

[21] Appl. No.: 140,844

[22] Filed: Apr. 16, 1980

[51] Int. Cl.[3] ..... F02N 11/00

[52] U.S. Cl. ..... 290/48; 74/7 R; 310/83

[58] Field of Search ..... 290/48, 38 R, 38 A, 290/38 C, 38 E, DIG. 11; 310/83; 74/7 R, 7 A, 7 B, 7 C, 7 D, 7 E, 6

[56] References Cited

U.S. PATENT DOCUMENTS

| | | | |
|---|---|---|---|
| Re. 20,686 | 4/1938 | Fitzgerald | 74/7 R |
| 3,666,958 | 5/1972 | Ruhle et al. | 290/48 |
| 3,791,685 | 2/1974 | Hamman | 290/38 |

*Primary Examiner*—J. V. Truhe
*Assistant Examiner*—Morris Ginsburg
*Attorney, Agent, or Firm*—Beaman & Beaman

[57] ABSTRACT

The invention pertains to electric starters for internal combustion engines, and in particular, to electric starters for small engines such as used with yard equipment, for instance, lawn tractors, snow blowers lawnmowers, and the like wherein the starter includes a pinion gear having cushioning means associated therewith which is of a variable characteristic such that soft cushioning is initially produced to protect the initial engagement of the pinion gear with the engine flywheel teeth, and stiffer cushioning occurs during high torque transmission during engine cranking. Preferably, the resiliency of cushioning achieved is proportional to the radius of contact between the cushioning means and the starter pinion gear.

11 Claims, 9 Drawing Figures

CUSHIONED STARTER PINION

BACKGROUND OF THE INVENTION

In Bendix type starters for internal combustion engines, a starter pinion is axially translated upon the starter motor shaft by threads wherein such axial translation engages the pinion gear teeth with the engine flywheel teeth to crank the engine. When the engine starts, the flywheel rotates the pinion gear at a rate faster than during cranking overriding the speed of the starter shaft and displacing the pinion back to its original axial starting position out of engagement with the flywheel teeth.

Normally the axis of the starter motor and the flywheel axis are parallel, and the pinion and flywheel teeth are parallel to their associated axis. Accordingly, the meshing of the pinion gear with the flywheel teeth occurs by a lateral insertion of the pinion teeth into the flywheel gear teeth. As the pinion gear teeth enter the flywheel teeth, or engage these teeth, shock and stress forces are imposed on the starter structure. Various cushioning devices have been used with Bendix type starters to cushion the stresses occuring during such gear engagement, and due to the operating characteristics of the Bendix type starter such engagement is momentary until tooth alignment occurs and the pinion gear is fully shifted to the cranking location.

In the assignee's U.S. Pat. No. 3,791,685 cushioning apparatus is disclosed usable with small combustion engines, and such cushioning apparatus comprises a resilient member interposed between a nut threaded upon the starter shaft and the pinion gear. Upon the axial displacement of the pinion gear being momentarily terminated due to engagement with the flywheel teeth the resilient material will absorb the shock and permit the teeth to align without damage to the starter and engine structure. However, there is a present tendency to manufacture engine flywheels of aluminum due to economics of manufacture, and as the pinion gear teeth must be formed of a wear resistant material, usually harder than the gear teeth of the flywheel, present pinion cushioning means is not sufficient to meet life cycle requirements with aluminum engine flywheels as the pinion will "hammer", chip and peen the aluminum teeth.

Also, while it is desirable that a "soft" cushioning action occurs in the event of pinion and flywheel tooth misalignment and impact, high torque is transmitted through the pinion gear during cranking, and while it is desirable that some cushioning occur during engine cranking this cushioning must be relatively "stiff" to prevent excessive twisting and deformation of the resilient cushioning material, and prior starter pinion cushioning devices have not been capable of providing a "soft" cushioning action during pinion alignment, and a "firm" cushioning during cranking.

It is an object of the invention to provide an engine starter pinion which includes variable cushioning means whereby a "soft" axial and rotative cushioning of the pinion occurs during initial engagement with the starter flywheel, and a "firm" cushioning subsequently occurs during engine cranking.

A further object of the invention is to provide engine starter structure wherein variable cushioning is provided for a starter pinion which is of a concise configuration and may be readily incorporated into a starter of existing dimensions having conventional operating characteristics whereby torsional forces are limited until positive engagement between gear teeth is initiated.

An additional object of the invention is to provide engine starter structure employing an annular cushioning ring which engages the end face of a starter pinion in a frictional manner, the face of the cushioning ring being obliquely related to the axis of gear rotation, and so related to the gear face, that a variable cushioning resiliency is produced proportional to the radial contact between the cushioning member and gear.

In the practice of the invention the starter pinion is axially displaceable upon the shaft of an electric starting motor. The pinion includes a metallic toothed portion and face which is bonded to, or engaged by, resilient cushioning material rotated and axially engaged by a drive nut. The drive nut is threaded upon the motor shaft and includes a radial flange bonded to or engaging an end of the resilient material, and frictional engagement between the nut structure, the resilient material and gear axially translates the starter pinion gear, and rotates the pinion gear during engine cranking.

The effective face of the resilient material driving the gear is of a variable axial dimension whereby axial forces imposed on the resilient material produce a changing variation in the configuration of the resilient material, and less axial and rotative forces are required to produce deformation during the initial interaction between the nut and pinion than during latter stages of pinion movement wherein the mass differential and dimensional variation of the resilient material provides sequential "soft" and "firm" cushioning characteristics.

In one embodiment the nut structure is such as to "snap-on" a combination metal and resilient material pinion, and assembly of the nut and pinion structure is readily accomplished. Additionally, axially extending holes or depressions may be defined in the nut flange to increase the torsional transmitting characteristics between the nut and pinion.

BRIEF DESCRIPTION OF THE DRAWING

The aforementioned objects and advantages of the invention will be appreciated from the following description and accompanying drawing wherein.

DESCRIPTION OF THE PREFERRED EMBODIMENTS

Figure 1:
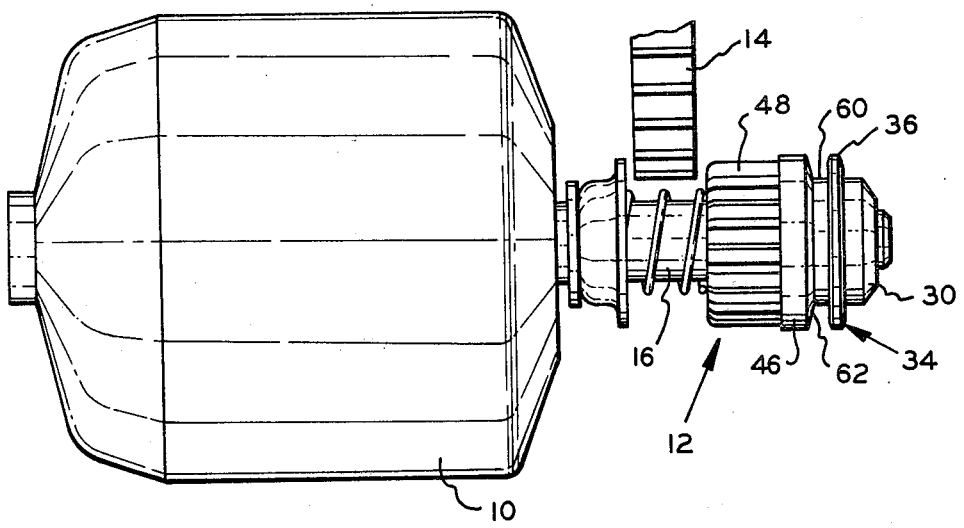
FIG. 1 is an elevational view of an embodiment of starter structure in accordance with the invention illustrating the starter pinion in the inoperative, retracted position.

While further embodiments of the invention are illustrated all have equivalent components and a basic starter structure is illustrated in FIG. 1 wherein the electric starter 10 rotates the Bendix type starter unit generally indicated at 12 for cranking the engine flywheel through the flywheel teeth as represented at 14. The starter motor 10 includes a drive shaft 16 which is provided with an annular groove 18 for receiving the snap ring 20. The snap ring 20 serves as an abutment for the stop cup 22 which is of a dish like configuration and includes a circular abutment edge 24.

Figure 3:
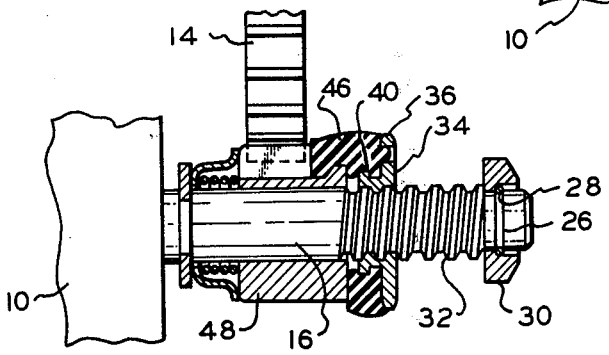
FIG. 3 is a detail, partially sectioned view of the starter pinion of FIGS. 1 and 2 illustrating the starter components during engine cranking.

At its outer end, the shaft 16 is provided with an annular groove 26 which receives a snap ring 28, FIG. 3, for maintaining an annular stop washer 30 upon the end of the shaft. The stop washer 30 retains the starter pinion upon the shaft when in the non-cranking or retracted position. The shaft 16 is threaded at 32, and these threads are of a heavy duty type and cooperate with the starter nut, as later described.

An annular nut 34 includes a threaded bore for cooperating with the thread 32, and the metal nut 34 includes an annular flange 36. A reduced diameter neck 38 is also defined upon the nut "inwardly" of flange 36. An annular projection 40 is defined upon the nut by the reduced diameter portion 38, and several axially extending holes 42, FIG. 2, are formed in the flange for torque transmitting purposes, as later described.

Figure 4:
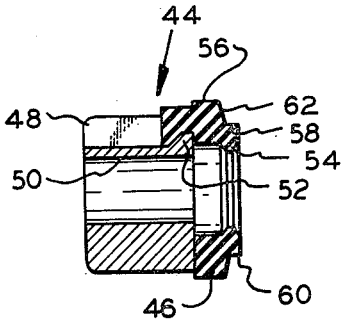
FIG. 4 is a diametrical elevational sectional view of the starter pinion assembly, used in FIGS. 1–3, per se.

The starter pinion gear is generally represented at 44, and includes a metal toothed portion 48 often formed of sintered metal, defining teeth which selectively engage with the flywheel teeth 14. The toothed portion 48 is formed with a bore 50 slightly larger than motor shaft 16 whereby the pinion 44 is rotatably supported upon the shaft 16, and is capable of axial displacement thereon. The portion 48 is also provided with a raised annular shoulder 52 which cooperates with the resilient material 46 bonded to the toothed portion 48 wherein the portions 46 and 48 become an integral assembly. The resilient portion 46 may be formed of rubber, or the like, and includes an annular inwardly extending lip 54, a reduced diameter portion 58 defined by a cylindrical surface 60, and a conical obliquely oriented surface 62 intersects the outer cylindrical surface 56, FIG. 4. The lip 54 is adapted to "snap" within the nut member reduced portion 38, and in this manner a mechanical interconnection is produced between the nut 34 and the pinion gear 44.

Figure 2:
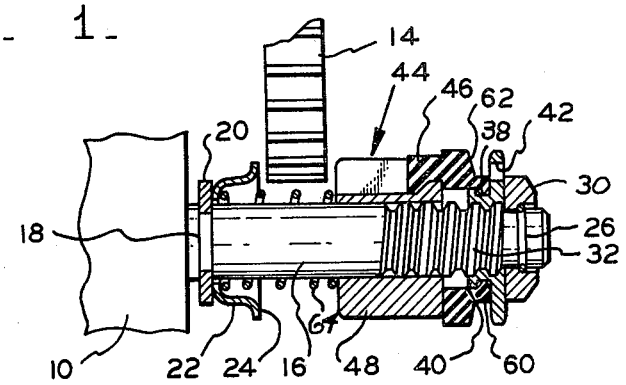
FIG. 2 is a detail, elevational, partially sectioned view of the starter pinion structure of FIG. 1 with the starter pinion in the retracted, non-cranking position.

After the gear 44 is assembled to the nut 34 in the manner illustrated in FIG. 2, a helical spring 64 is placed upon the shaft 16 for engagement with the cup 22. The gear and nut assembly 34–44 is then placed upon the shaft 16, the stop washer 30 placed thereon, and the snap ring 28 is placed within groove 26 to complete the assembly. Under its normal condition, the starter components will be as shown in FIG. 2.

When it is desired to start the internal combustion engine associated with flywheel 14 the operator energizes electric starter motor 10 through an appropriate switch, not shown. The shaft 16 will then rotate in a direction axially displacing the pinion gear 44 to the left, FIG. 2, toward the flywheel 14. This axial translation results from the relative rotation of the shaft 16 to the pinion gear due to the inertia of the pinion gear and nut 34, and if the teeth of portion 48 are aligned with the teeth 14 the gear 44 will move to the position shown in FIG. 3 wherein the left end of the portion 48 engages the abutment member 22 at edge 24.

In that the teeth of portion 48 will often be misaligned with the flywheel teeth 14 the forward edge of teeth 48 will encounter the edge of the flywheel teeth 14 preventing further axial displacement of the pinion 44 on shaft 16. This impact is cushioned by the resilient material 46 which is interposed between the toothed portion 48 and the nut 34, and upon such impact the resilient material portion 58 defined by surface 60 will be axially and radially compressed by the nut flange 34. Due to the relatively small volume and mass of resilient material within the portion 58 the cushioning provided by portion 58 is relatively "soft" to effectively cushion the impact of the pinion gear 44 with the flywheel, and even though the flywheel 14 may be of a relatively soft material such as aluminum, the soft cushioning provided by portion 58 will prevent damage to the flywheel and its teeth due to engagement with the pinion 44.

Upon engagement of the pinion gear with the flywheel teeth 14 the rotative motion of the pinion after impact will align the teeth of portion 48 with teeth 14 permitting the pinion 44 to move to its fully engaged cranking position shown in FIG. 3, and upon the abutment surface 24 being contacted the resilient material 46 now becomes highly compressed by the nut flange 36 causing the flange 36 to engage the surface 62, and at this time the "firm" cushioning produced by the entire radial mass of the portion 46 is achieved. The compression of the resilient material 46 during cranking as shown in FIG. 3 causes the resilient material to extrude into the flange openings 42 increasing the torque transmitting characteristics between the nut 34 and the pinion gear 44, and as engine cranking requires relatively high torque the presence of the openings 42 effectively aids the operation of the pinion gear.

Upon the engine starting the flywheel 14 will rotate faster than the starter pinion gear 44. Upon the flywheel rotating the pinion gear 44 at a faster rate than during cranking the pinion will move to the right to the non-cranking or at-rest position of FIG. 2, disengaging the pinion from the flywheel and the engine operation will continue with the starter structure disengaged from the flywheel. The spring 64 will bias the pinion 44 to the right to maintain disengagement from the flywheel due to vibration. Of course, electric motor 10 deenergizes as soon as the internal combustion engine starts.

Accordingly, the presence of the small mass portion of resilient material at 58 produces an initial "soft" cushioning of the impact of the pinion starter with the flywheel 14, and after the pinion fully engages the flywheel teeth, FIG. 3, the greater mass of the resilient material 46 is employed to cushion the starter pinion gear operation during cranking. This "firm" cushioning minimizes shock and impact on the starter apparatus during engine cranking, and also adds to the effective life of the pinion and flywheel gear teeth.

Various embodiments to the invention are also shown in FIGS. 5–9, and in these embodiments the resilient cushioning material, rather than being bonded to the starter pinion gear, is bonded to the nut. It is also to be appreciated that the cushioning material could be interposed between the nut flange and the end of the starter pinion, without being bonded to either component, and various structural relationships between the nut, pinion gear and cushioning material are possible within the concepts of the invention.

Wear on the cushioning member increases with the radius of contact between the cushioning member and the gear, or nut, due to the greater tangential displacement between the engaged components due to the greater distance from the axis of the starter motor shaft. Also, the greater the distance from the axis of the starter motor shaft, the greater amount of resilient material is desirable due to the proportionally greater tangential deflections under torsional loads. Accordingly, best results are achieved wherein initial contact between the resilient material and the nut flange, or gear face, is achieved when the initial contact to provide a "soft" cushioning occurs at the minor dimensions of the resilient material closest to the starter shaft motor axis. In the embodiments shown in FIGS. 5–9, the contact between the resilient material, and the engaged gear face, is such that the variable cushioning resilience provided is proporational to the radial distance from the shaft axis.

Figure 5:
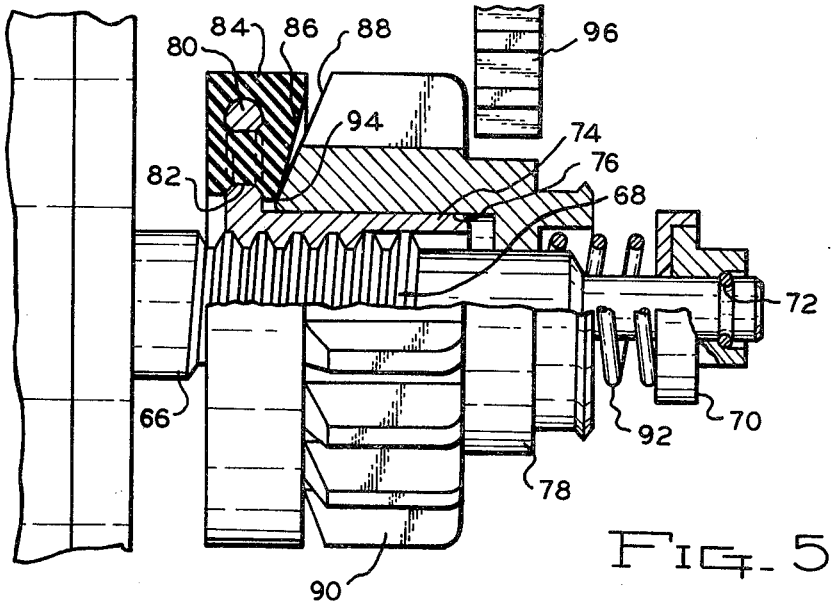
FIG. 5 is an enlarged, partially sectioned, elevational view of another embodiment of cushioned starter structure in accord with the inventive concepts illustrating the components in the normal non-cranking relationship.
Figure 6:
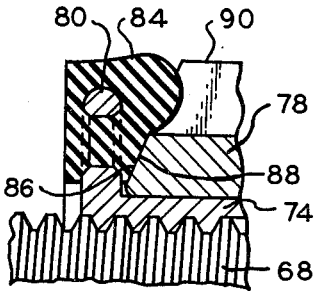
FIG. 6 is a detail sectional view illustrating the relationship of the cushioned material and pinion gear face of the embodiment of FIG. 5 during cranking.

In FIGS. 5 and 6, the starter motor shaft 66 is provided with threads 68 and a stop washer 70 fixed to the outer end of the shaft by snap ring 72. The nut 74 includes internal threads which mate with the shaft threads 68, and the nut hub includes a cylindrical surface 76 upon which the metal pinion gear 78 is rotatably mounted, and axially movable thereon. The nut 74 includes a radial flange 80 having axial holes 82 defined therein and the elastomer cushioning material 84 is bonded to the nut flange 80 to form an integral part therewith.

The elastomer material 84 is provided with an effective friction face 86 which is of a conical nature converging toward the axis of the shaft 66, and the opposed gear surface 88 is also obliquely related to the horizontal in a similar direction as surface 86, the surface 88 being partially formed on the edges of the gear teeth 90 and the gear hub. A compression spring 92 interposed between the stop washer 70 and the gear 78 biases the gear to the left for initial engagement at 94 with the resilient material 84. The flywheel teeth are represented at 96, and when the starter components are in the non-cranking position shown in FIG. 5 the gear teeth 90 will be disengaged from the flywheel teeth 96.

Upon rotation of the shaft 66 in an engine cranking direction the nut 74 will move to the right forcing the resilient material surface 86 into engagement with the gear surface 88. As initial engagement between the gear and resilient material 84 is at the resilient material minor diameter at 94, the reduced area of contact of resilient material at 94 will provide initial "soft" cushioning between the nut 74, resilient material 84 and gear 78. Increased axial resistance of movement of the gear 78 toward the right, either due to impact with the flywheel teeth 96, or during cranking, forces more of the resilient surface 86 into engagement with the gear surface 88 which results in firmer cushioning between the resilient material and gear, and increases the frictional relationship between surfaces 86 and 88. Under the highest torque and frictional engagement the major or outer diameter of the resilient material 84 will extrude between the gear teeth 90, as well as engage the gear surface 88 throughout its radial dimension, and a firm cushioning and high torque transmitting relationship is established between nut 74 and gear 78, with a minimum of relative rotational displacement.

Upon the engine starting, and the flywheel rotating the gear 78 faster than during cranking, the components will return to the relative positions shown in FIG. 5.

Figure 7:
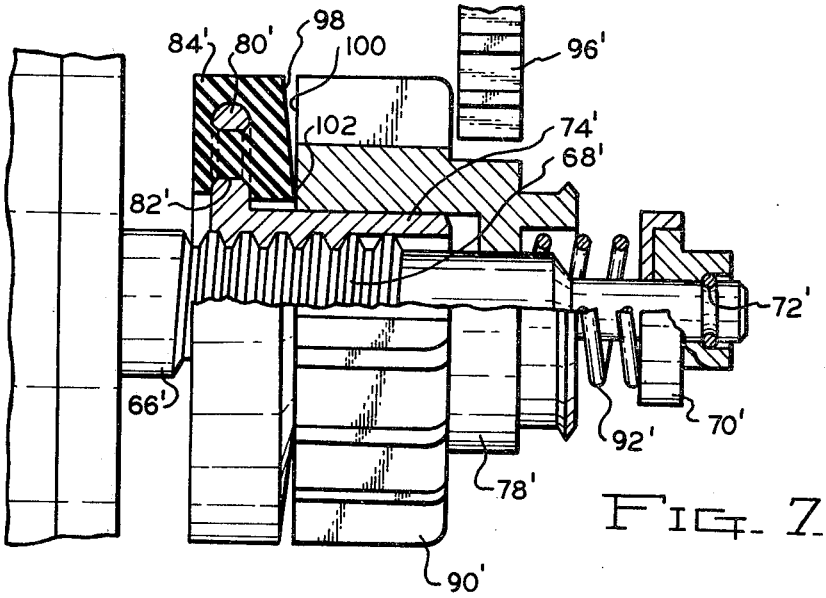
FIG. 7 is an enlarged, partially sectioned, elevtional view of another embodiment of starter structure in accord with the inventive concepts illustrating the pinion gear and flywheel gear disengaged.
Figure 8:
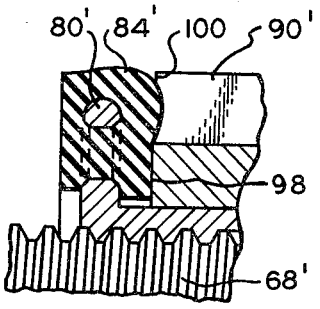
FIG. 8 is a detailed sectional view of the resilient material and engaged pinion gear face of the embodiment of FIG. 7 during cranking.

In the embodiment of FIGS. 7 and 8 the shaft, gear, nut, stop washer, spring and flywheel are substantially similar to those disclosed with respect to FIGS. 5 and 6, and similar components are indicated with like primed reference numerals.

In FIGS. 7 and 8, the resilient material 84′ is provided with a conical friction face 98 which converges toward the axis of the shaft 66′, but in the direction toward the right, FIG. 7, in counter distinction with respect to the surface 86 of FIG. 5. In this embodiment the gear face 100 is perpendicularly disposed to the axis of shaft 66′, and engages the surface 98 at 102, the minor diameter of the resilient cushioning material. When the embodiment of FIGS. 7 and 8 is operated the initial engagement between the resilient material 84′ and gear 78′ occuring at 102 provides the initial "soft" cushioning, and as the resistance of movement of the gear 78′ to the right increases additional portions of the surfaces 98 and 100 will engage as the torque and axial forces transmitted through these surfaces increases. FIG. 8 illustrates the relationship of the resilient material 84′ and the gear 78′ during maximum cranking, and it will be appreciated that a portion of the resilient material adjacent its major diameter will extrude between the gear teeth 90′.

Due to the relative angular relationships between surfaces 86 and 88, and 98 and 100, it will be appreciated that although the axial cushioning forces produced increasingly become firmer as the axial and rotational load between the nut and gear increases this increase in the cushioning is proportional to the radius of contact between these surfaces, and this proportion can be accurately controlled by forming the engaging resilient material and gear surfaces of the desired angles. Thus, optimum operating characteristics between the resilient material and gear may be preselected and assured.

Figure 9:
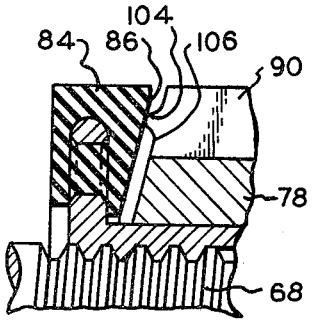
FIG. 9 is an enlarged, sectional, elevational view of a further embodiment of resilient cushioning material and a pinion gear configuration utilizing the concepts of the invention.

In the embodiment of FIG. 9 the components are similar to those described with respect to FIGS. 5 and 6, and like reference numerals are employed. The difference in the embodiment of FIG. 9 lies in the existence of an annular axially extending annular rib 104 defined upon the gear face 106 which is substantially parallel to the resilient material face 86. The rib 104, although located near the major diameter of the resilient material, due to increased thickness of resilient material at that radius, provides soft initial cushioning, and as the torque an axial forces increase the surfaces 86 and 106 will fully engage in the manner previously described. In this embodiment the variable resiliency is achieved due to the configuration of the rib 104, and due to the surfaces 86 and 106 fully engaging when maximum cranking forces are being transmitted to the gear 78.

It is appreciated that various modifications to the inventive concepts may be apparent to those skilled in the art without departing from the spirit and scope of the invention.

I claim:

1. In an electric starter for internal combustion engines including an electric motor having a rotatable shaft having a screw thread defined thereon, a nut member threaded upon said shaft thread wherein relative rotation thereon axially translates said nut member on said shaft, a pinion gear member concentrically mounted on said shaft for rotational and axial movement thereon, a stop mounted on said shaft limiting movement of said gear member upon said shaft, the improvement comprising a variable compression characteristic resilient member formed of elastic resilient deformable material interposed between the nut member and pinion gear member establishing a frictional rotative drive between the nut member and gear member for rotating the gear member and variably cushioning the gear member relative to axial forces imposed thereon by the nut member whereby initial cushioning of axial forces is relatively soft and sequentially cushioning increases in stiffness, said resilient member being circumferentially unconfined to permit radial expansion of said resilient material thereof, and an axially extending projection defined upon one of said members axially extending toward the adjacent member causing limited radial displacement and deformation of said resilient member material during initial cushioning.

2. In an electric starter as in claim 1, said resilient member including a first face surface transversely disposed to the length of the motor shaft, said face surface having an inner minor diameter and an outer major diameter, said diameters being relatively axially spaced with respect to each other and said shaft, said resilient member transmitting initial axial forces between said nut member and gear member adjacent said minor diameter and increasing transmitted axial forces are increasingly distributed through said resilient member radially outward toward said major diameter.

3. In an electric starter as in claim 2, said first face surface being of a conical configuration.

4. In an electric starter as in claim 2, said resilient member rotating with the nut member during rotative drive of said gear member, the gear member including a second face surface transversely disposed to the length of the motor shaft engagable by said first face surface during rotative drive of the gear member, said face surfaces being nonparallel to each other and initially engaging adjacent said first face surface minor diameter wherein the area of engagement of said face surfaces progressively increases from said minor diameter to said major diameter as axial forces between the nut member and gear member increase.

5. In an electric starter as in claim 4, said second face surface defined upon the gear member being conical and converging toward said first face minor diameter.

6. In an electric starter as in claim 4, said first face surface converging in the direction of the gear member.

7. In an electric starter as in claim 1, said axially extending projection being defined upon the gear member engageable with said resilient member and adapted to impose a variable cushioning between said resilient member and the gear member during rotation of the gear member.

8. In an electric starter as in claim 1, said axially extending projection being defined on said resilient member and extending toward the nut member for engagement therewith, said projection having a reduced radial dimension and reduced mass permitting deformation under relatively small axial forces.

9. In an electric starter for internal combustion engines as in claim 1, said nut member including a radial flange, said resilient member comprising a resilient body bonded to the pionion gear member, said body including a radial end in opposed relation to said nut member flange, said radial end being defined by a first maximum radial dimension portion and a second minimum radial dimension portion, said second portion being axially located intermediate said flange and first portion whereby said flange initially engages and compresses said second portion upon axial displacement of nut member toward the gear member to provide a soft cushioning of the initial axial forces transmitted between the gear member and nut member.

10. In an electric starter for internal combustion engines including an electric motor having a rotatable shaft having a screw thread defined thereon, a nut member threaded upon the shaft thread having a radially extending flange wherein rotation of the nut member upon the shaft thread axially displaces said nut member upon the shaft, the improvement comprising, a pinion gear rotatably mounted upon the shaft and axially displaceable thereon, an elastic body bonded to the gear, said body including a radial end in opposed relation to the nut member flange, said radial body end including a first radial surface of first radial dimension, an axially extending projection extending from said first surface having a second radial dimension less than that of said first dimension, the nut member flange initially engaging said projection upon rotation of the shaft in an engine cranking direction whereby said projection deforms and provides an initial relatively soft cushioning of axial forces imposed on the gear by the nut member.

11. In an electric starter as in claim 10 wherein said body includes a radially extending lip concentric with the axis of the nut member, and a concentric recess defined within the nut member snugly receiving said lip whereby the nut member and said body are mechanically interconnected with the nut member flange in engagement with said projection.

* * * * *